US010101128B2

(12) United States Patent
Cushingham et al.

(10) Patent No.: US 10,101,128 B2
(45) Date of Patent: Oct. 16, 2018

(54) FABRICS WITH BALLISTIC PROTECTION AND GARMENTS MADE FROM SAME

(71) Applicant: Southern Mills, Inc., Union City, GA (US)

(72) Inventors: Steven John Cushingham, Woodstock, GA (US); Michael T. Stanhope, Atlanta, GA (US); Charles S. Dunn, Griffin, GA (US)

(73) Assignee: Southern Mills, Inc., Union City, GA (US)

( * ) Notice: Subject to any disclaimer, the term of this patent is extended or adjusted under 35 U.S.C. 154(b) by 687 days.

(21) Appl. No.: 14/139,085

(22) Filed: Dec. 23, 2013

(65) Prior Publication Data

US 2014/0245516 A1 Sep. 4, 2014

Related U.S. Application Data

(60) Provisional application No. 61/848,150, filed on Dec. 21, 2012, provisional application No. 61/852,253, filed on Mar. 15, 2013.

(51) Int. Cl.

| | |
|---|---|
| ***F41H 1/02*** | (2006.01) |
| ***D04B 1/16*** | (2006.01) |
| ***F41H 5/02*** | (2006.01) |
| ***F41H 5/04*** | (2006.01) |
| *F41H 3/02* | (2006.01) |

(52) U.S. Cl.

CPC ..... *F41H 1/02* (2013.01); *D04B 1/16* (2013.01); *F41H 5/02* (2013.01); *F41H 5/0485* (2013.01); *F41H 3/02* (2013.01); *Y10T 442/40* (2015.04); *Y10T 442/444* (2015.04)

(58) Field of Classification Search

CPC ..... D04B 1/16; F41H 1/02; F41H 3/02; F41H 5/02; F41H 5/0485; Y10T 442/40; Y10T 442/444

USPC ..... 2/2.5; 442/134, 135, 304, 311; 428/911, 428/920, 921

See application file for complete search history.

(56) References Cited

U.S. PATENT DOCUMENTS

| | | | | |
|---|---|---|---|---|
| 3,040,551 | A | 2/1956 | Urlaub | |
| 4,522,871 | A | 6/1985 | Armellino, Jr. et al. | |
| 5,167,876 | A | 12/1992 | Lem et al. | |
| 6,132,476 | A | 10/2000 | Lunsford et al. | |
| 6,547,835 | B1 | 4/2003 | Lunsford et al. | |
| 6,626,964 | B1 | 9/2003 | Lunsford et al. | |
| 6,818,024 | B2 | 11/2004 | Lunsford et al. | |
| 6,861,378 | B2 | 3/2005 | Cunningham et al. | |
| 6,867,154 | B1 | 3/2005 | Lunsford et al. | |
| 7,073,538 | B2 | 7/2006 | Bhatnagar et al. | |
| 7,241,709 | B2 | 7/2007 | Chiou et al. | |
| 7,770,372 | B2 | 8/2010 | Kolmes et al. | |
| 8,017,532 | B2 | 9/2011 | Okada | |
| 2003/0098068 | A1 | 5/2003 | Chi et al. | |
| 2007/0099526 | A1 | 5/2007 | Heerden et al. | |
| 2008/0057807 | A1 | 3/2008 | Tutterow et al. | |
| 2008/0138566 | A1 | 6/2008 | Stewart et al. | |
| 2008/0227352 | A1 | 9/2008 | Byles et al. | |
| 2009/0297816 | A1 | 12/2009 | Arvidson et al. | |
| 2010/0075557 | A1 | 3/2010 | Shteiyer | |
| 2010/0143683 | A1 | 6/2010 | Chiou | |
| 2011/0126335 | A1* | 6/2011 | Schultz | B32B 5/26 2/2.5 |
| 2012/0183747 | A1 | 7/2012 | Bader et al. | |
| 2012/0210481 | A1 | 8/2012 | Rock et al. | |
| 2013/0118635 | A1* | 5/2013 | Layson, Jr. | D03D 15/0005 139/420 R |
| 2014/0245516 | A1* | 9/2014 | Cushingham | F41H 1/02 2/2.5 |
| 2014/0331375 | A1* | 11/2014 | Howland | A41D 1/02 2/2.5 |
| 2015/0247706 | A1* | 9/2015 | Freier | F41H 1/02 2/2.5 |

FOREIGN PATENT DOCUMENTS

| | | |
|---|---|---|
| WO | WO 1993/00564 A1 | 1/1993 |
| WO | WO 94/21450 | 9/1994 |
| WO | WO 2007/067405 A1 | 6/2007 |
| WO | WO 2010/091476 | 8/2010 |

OTHER PUBLICATIONS

International Search Report and Written Opinion, PCT Application No. PCT/US13/77528, dated Aug. 22, 2014.

Figucia, "Energy Absorption of Kevlar® Fabrics Under Ballistic Impact," Jun. 1980, pp. 29-41.

Information Paper, NSRDEC/ARL, Public Release U12-382, Aug. 20, 2012, 3 pages.

"Purchase Description Cloth, Flame Resistant," GL-PD-07-12, Rev. 5, Sep. 9, 2012 (15 pages).

"Purchase Description Shirt, Combat, Flame Resistant," GL-PD-10-02C, Sep. 1, 2010 (32 pages).

Solicitation/Contract/Order for Commercial Items, Standard Form 1449, Mar. 2005 (64 pages).

Solicitation/Contract/Order for Commercial Items, Standard Form 1449, Mar. 2005 (43 pages).

Enhanced Army Combat Shirt (EACS), undated (1 page).

Enhanced Army Combat Pant (EACP), undated (1 page).

Protective Under-Garment (PUG), undated (1 page).

International Preliminary Report on Patentability, PCT Application No. PCT/US13/77528, dated Jul. 2, 2015.

MIL-STD-662F, Department of Defense Test Method Standard, V50 Ballistic Test for Armor, Dec. 18, 1997.

* cited by examiner

*Primary Examiner* — Arti Singh-Pandey

(74) *Attorney, Agent, or Firm* — Kilpatrick Townsend & Stockton LLP

(57) ABSTRACT

Fabrics having fiber blends and constructions engineered to enhance the ballistic protection as well as the comfort and/or dyeability/printability of such fabrics.

37 Claims, No Drawings

FABRICS WITH BALLISTIC PROTECTION AND GARMENTS MADE FROM SAME

CROSS-REFERENCE TO RELATED APPLICATIONS

This application claims the benefit of U.S. Provisional Application No. 61/848,150, filed Dec. 21, 2012, and U.S. Provisional Application No. 61/852,253, filed Mar. 15, 2013, the entirety of both of which are herein incorporated by reference.

FIELD

Embodiments of the present invention relate to fabrics that provide ballistic protection as well as garments made from such fabrics.

BACKGROUND

In combat environments, much attention is focused on preventing injuries caused by relatively large projectiles and fragmentation, such as those emanating from improvised explosive devices. However, significant damage can also be caused by ejecta (small particles of sand and other fine grain projectiles typically moving between 500-1200 ft./sec.) that penetrate through garments and harm underlying skin and tissue. If left in skin and tissue, the ejecta can cause infection which can ultimately lead to amputation of the affected area. While a number of ballistic fabrics have been developed and provide protection, none do so while still being comfortable to the wearer and dyeable/printable. Thus, there is a need to provide fabrics that afford protection against ejecta while being comfortable to the wearer and dyeable/printable.

The ability of a fabric to protect against ejecta is measured pursuant to the testing methodology set forth in MIL-STD-662F, Department of Defense Test Method Standard, $V_{50}$ Ballistic Test for Armor, Dec. 18, 1997. The required performance of a fabric tested pursuant to this methodology is dependent on the garment in which the fabric is to be used.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Certain embodiments of the present invention provide fabrics having fiber blends and constructions engineered to enhance the ballistic protection of such fabrics (or the garments into which the fabrics are made or otherwise incorporated) while also enhancing the comfort and/or dyeability/printability of such fabrics.

DETAILED DESCRIPTION

Fabrics according to embodiments of this invention have fibers and constructions that enhance the ballistic protection of the fabric. Fabrics according to some embodiments of this invention may also be, but do not have to be, flame resistant. For example, the fabrics may comply with the thermal protective requirements set forth in NFPA 2112 (2007), including having acceptable char lengths (as measured with the testing method set forth in ASTM D6413), as well as GL-PD-07-12 Rev. 5 (Sep. 28, 2012) and GL-PD-10-02C (Sep. 1, 2010), the entirety of which are hereby incorporated by reference.

In some embodiments, the fabric includes fibers that enhance the ballistic protection of the fabric (referred to as "ballistic fibers"). The ballistic fibers may be stretch broken ballistic fibers, staple ballistic fibers (including long and short staple), and/or filament ballistic fibers, or a combination of such fibers. The ballistic fibers used in some embodiments of the fabrics contemplated herein include, but are not limited to, para-aramid fibers, ultra-high density polyethylene fibers, polybenzoxazole (PBO) fibers, carbon fibers, silk fibers, polyamide fibers, polyester fibers, and poly{2,6-diimidazo[4,5-b:40; 50-e]-pyridinylene-1,4(2,5-dihydroxy) phenylene} ("PIPD") fibers. Examples of para-aramid fibers include KEVLAR™ (available from DuPont), TECHNORA™ (available from Teijin Twaron BV of Arnheim, Netherlands), and TWARON™ (also available from Teijin Twaron By). Examples of ultra-high density polyethylene fibers include Dyneema and Spectra. An example of a polyester fiber is VECTRAN™ (available from Kuraray). An example of a PIPD fiber includes M5 (available from Dupont).

In some embodiments, the fabrics are formed from 100% ballistic fibers. For example, all of the yarns in the fabric may be formed with 100% of a single type of ballistic fiber or alternatively a blend of different ballistic fibers. Moreover, yarns formed from 100% ballistic fibers may be all or an intimate blend of staple fibers, a combination of filament fibers, or a combination of filament fibers and staple fibers.

In other embodiments, the fabric includes ballistic fibers (such as those disclosed above) and one or more types of secondary fibers that are used to enhance a secondary property of the fabric other than ballistic protection (e.g., comfort, dyeability/printability, etc.) (referred to as "secondary fibers"). The secondary fibers can be staple or filament fibers and can be flame resistant or used in their non-flame resistant state (to the extent possible). For example, some embodiments of the fabric may be formed from yarns having 100% ballistic fibers (such as those disclosed above) and yarns that include one or more types of secondary fibers (either in addition to, or to the exclusion of, ballistic fibers). In other embodiments, yarns forming the fabric are formed from a blend of one or more ballistic fibers (such as those disclosed above) and one or more types of secondary fibers. The blended yarns may be a combination of spun fibers, a combination of filament fibers, or a combination of filament fibers and staple fibers.

Such secondary fibers can be selected to enhance a property of the fabric, such as, but not limited to, the comfort, durability, and/or dyeability/printability of the fabric.

Secondary fibers that enhance the comfort of the fabric (i.e., have higher moisture regain, soft hand, etc.) are referred to herein as "comfort fibers." "Comfort fibers" as used herein include, but are not limited to, cellulosic fibers, polybenzimidazole (PBI) fibers, TANLON™ (available from Shanghai Tanlon Fiber Company), rayon, wool, and blends thereof. Examples of cellulosic fibers include cotton, rayon, acetate, triacetate, MODAL™, and lyocell fibers (as well as their flame resistant counterparts FR cotton, FR rayon, FR acetate, FR triacetate, and FR lyocell). An example of a suitable rayon fiber is Viscose by Lenzing, available from Lenzing Fibers Corporation. Examples of lyocell fibers include TENCEL G100™ and TENCEL A100™, both available from Lenzing Fibers Corporation. Examples of FR rayon fibers include Lenzing FR™ and Lenzing RF™, also available from Lenzing Fibers Corporation, and VISIL™, available from Sateri.

Secondary fibers that enhance the dyeability/printability of the fabric are referred to herein as "dyeable fibers" and include fibers that are dyeable and dyestuff printable (as opposed to pigment printable). "Dyeable fibers" as used herein include, but are not limited to, modacrylic fibers, cellulosic fibers, meta-aramid fibers, polybenzimidazole (PBI) fibers, melamine fibers, TANLON™ (available from Shanghai Tanlon Fiber Company), rayon, polyester, polyvinyl alcohol, wool, polyetherimide, polyethersulfone, polyamide, and blends thereof. An example of suitable modacrylic fibers are PROTEX™ fibers available from Kaneka Corporation of Osaka, Japan, SEF™ available from Solutia, or blends thereof. Examples of cellulosic fibers include cotton, rayon, acetate, triacetate, MODAL™, and lyocell fibers (as well as their flame resistant counterparts FR cotton, FR rayon, FR acetate, FR triacetate, and FR lyocell). An example of a suitable rayon fiber is Modal by Lenzing, available from Lenzing Fibers Corporation. Examples of lyocell fibers include TENCEL G100™ and TENCEL A100™, both available from Lenzing Fibers Corporation. Examples of FR rayon fibers include Lenzing FR™ and Lenzing RF™, also available from Lenzing Fibers Corporation, and VISIL™, available from Sateri. Examples of meta-aramid fibers include NOMEX™ (available from DuPont), CONEX™ (available from Teijin), and Kermel (available from Kermel). An example of melamine fibers is BASOFIL™ (available from Basofil Fibers).

In some embodiments, the ballistic fibers comprise 25-100% and the secondary fibers (comfort fibers, dyeable fibers, or some combination of both) comprise 0-75% of the fibers in the fabric. In some embodiments, the ballistic fibers comprise 25-80% and the secondary fibers (comfort fibers, dyeable fibers, or some combination of both) comprise 20-75% of the fibers in the fabric. In some embodiments, the ballistic fibers comprise 45-70% and the secondary fibers (comfort fibers, dyeable fibers, or some combination of both) comprise 30-55% of the fibers in the fabric. In some embodiments, the ballistic fibers comprise 40-60% and the secondary fibers comprise 40-60% of the fibers in the fabric. It may be, but will not always be, the case that, to the extent a smaller percentage of ballistic fibers are used in the fabric, the fabric weight may need to be increased to achieve the desired ballistic protection.

The fabric may also include fibers in addition to the ballistic and secondary fibers identified above. For example, some fabric embodiments may also include fibers that enhance static dissipation of the fabric (referred to herein as "antistat fibers"). Examples of antistat fibers can include, but are not limited to, fibers having a carbon core surrounded by a nylon or polyester sheath. An example of an antistat fiber includes No-Shock® (available from Ascend Performance Materials), and an example of an antistat filament yarn includes Mega-Stat® (available from Barnet).

The yarns in the fabric may be spun or filament yarns and can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc.

In some embodiments, the fabrics can be formed entirely from yarns having identical fiber blends (i.e., all of the yarns in the fabric are the same) such that the fabrics have the overall blends of ballistic and secondary fibers set forth above. Where identical yarns are used, the fabrics may be formed by traditional weaving technology and traditional knitting technology (e.g., warp knits with various styles and constructions (such as raschel, tricot, and simplex) and weft knits with various styles and constructions (such as flat bed and circular knits, such as double knits (including swiss pique, rib, interlock, etc.) and single knits (including jersey and pique))).

However, in other embodiments, the yarns forming the fabric may not all be identical. For example, it may be desirable to form the fabric from a first type of yarn engineered more for ballistic protection (hereinafter referred to as the "ballistic yarns") and a second type of yarn engineered more for a secondary property, such as comfort and/or dyeability/printability (hereinafter referred to as the "secondary yarns").

Use of the terms "ballistic yarns" and "secondary yarns" is not meant to suggest that the ballistic yarns do not or cannot impart comfort and/or dyeability/printability or that the secondary yarns do not or cannot impart any ballistic protection. The ballistic yarns may include a higher percentage of ballistic fibers than the secondary yarns to impart ballistic protection to the fabric, and the secondary yarns may include a higher percentage of secondary fibers (comfort fibers or dyeable fibers) to impart comfort and dyeability/printability, respectively, to the fabric. However, such may not always be the case.

The ballistic yarns may be formed of one type of ballistic fiber or formed from a combination of fibers (ballistic fibers, secondary fibers, antistat fibers, or other types of fibers). The ballistic yarns may be spun or filament yarns and can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc.

In some embodiments, the ballistic yarns are formed with 100% ballistic filament yarns. In some embodiments, the ballistic yarns include 100% para-aramid filament yarns. In other embodiments, the ballistic yarns include 100% high density polyethylene filament yarns.

The ballistic yarns may also be spun yarns. In one such non-limiting embodiment, the ballistic yarns are formed of a blend of 80-100% para-aramid fibers and 0-20% cellulosic fibers. In another embodiment, the ballistic yarns are formed of a blend of 50-80% para-aramid fibers and 20-50% cellulosic fibers. Additional fiber types (including, but not limited to, other of the ballistic fibers, comfort fibers, dyeable fibers, antistat fibers, etc.) may also be included in such blends.

The secondary yarns may be formed of one type of secondary fiber or formed from a combination of fibers (ballistic fibers, secondary fibers, antistat fibers, or other types of fibers). In some embodiments, the secondary yarns include a combination of fibers. The secondary yarns may be spun or filament yarns and can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc.

Exemplary but non-limiting combinations of secondary yarns include, but are not limited to: (i) 20-100% cellulosic fibers and 0-80% para-aramid fibers; (ii) 20-50% cellulosic fibers and 50-80% para-aramid fibers; (iii) 30-50% cellulosic fibers, 30-50% modacrylic fibers, and 0-40% para-aramid fibers; (iv) 20-100% meta-aramid fibers and 0-80% cellulosic fibers; (v) 20-100% nylon fibers and 0-80% cellulosic fibers; and (vi) 20-100% modacrylic fibers and 0-80% cellulosic fibers. Such blends may be tailored depending on the desired secondary property of the fabric (comfort, dyeability/printability, etc.). Moreover, such blends may also include other fibers types (including, but not limited to, other of the ballistic fibers, comfort fibers, and/or dyeable fibers identified above).

The ballistic yarns may be combined with secondary yarns in various ways to form various fabric embodiments. Yarns formed of differing fiber blends (e.g., ballistic and secondary yarns) may be woven or knitted in different ways, some of which result in different properties being imparted to different sides of the fabric.

For example and with respect to weaving, one of the warp or fill yarns could be of the ballistic yarns and the other of the warp or fill yarns could be of the secondary yarns. The fabric could be woven (such as via a twill or Satin weave construction) so that the warp and fill yarns (and thus the ballistic and secondary yarns) are exposed predominantly on opposing sides of the fabric. In this way, one side of the fabric contributes more ballistic protection while the other side of the fabric contributes more of the desired secondary property (comfort, dyeability/printability, etc., depending on the make-up of the secondary yarns). In other embodiments, not all of the warp or fill yarns are the same. For example, ballistic and secondary yarns may be provided in both the warp and fill directions by providing ballistic yarns on some ends and picks and secondary yarns on other ends and picks (in any sort of random arrangement or alternating pattern). Or all of the yarns in one of the warp or fill direction could be identical and different yarns used only in the other of the warp or fill direction.

Similarly and with respect to knitting, ballistic yarns may be knitted with secondary yarns in a variety of ways. The ballistic and secondary yarns may be knitted using single knit technology (e.g., plating) or double-knit technology such that the ballistic yarns will be located primarily on one side of the fabric to enhance ballistic protection and the secondary yarns will be located primarily on the opposing side of the fabric to enhance comfort or dyeability/printability (or whatever secondary property the secondary yarn is tailored to have) to the fabric.

In yet another embodiment, the ballistic and secondary yarns are knitted so that alternating courses and/or wales of the fabric are formed by different yarn types. In still yet another embodiment, the fabric may be knitted (such as using double-knit plating technology) such that one of the ballistic and secondary yarns is embedded within the fabric so as not to be exposed on a fabric surface and the other of the ballistic and secondary yarns is exposed on both sides of the fabric. In some embodiments, the ballistic yarn is embedded in the fabric to enhance the ballistic protection of the fabric while leaving the secondary yarns exposed on the fabric surface to enhance the comfort or dyeablity/printability to the fabric.

Fabrics formed of ballistic and secondary yarns provided on opposing sides of the fabric may be oriented in a variety of ways within a garment, depending on the use of the garment. For example, if incorporated into garments where it is desirable that the exterior of the garment be dyed or printed (e.g., camouflage), it may useful to incorporate secondary yarns into the fabric and expose the side of the fabric with the secondary yarns (which will typically be more conducive to dyeing and/or printing) on the exterior of the garment and the ballistic yarns facing the wearer. Alternatively, if dyeing or printing of the fabric is of no consequence, it may be desirable to incorporate secondary yarns into the fabric and position the side of the fabric with the secondary yarns (which will typically be more comfortable) in the garment so that the comfort yarns are facing the wearer.

In some embodiments, it may be desirable, but certainly not required, to incorporate stretchable yarns ("stretch yarns") into the fabrics, which may improve the ballistic protection of the fabrics. Stretch yarns may be yarns formed from inherently elastic materials such as spandex (elastane), ethylene-olefin copolymer, rubber or similar elastomeric-type materials or alternatively could be formed from non-inherently stretchable yarns (e.g., nylon yarns, polyester yarns, etc.) that have been chemically or physically altered (such as via crimping, texturing, etc.) to render them elastic or stretchable. Examples of spandex fibers include LYCRA™ (available from Invista), DORLASTAN™ (available from AsahiKasei Spandex America), and RadiciSpandex. Examples of ethylene-olefin copolymer fibers include Dow XLA™ composite fibers.

In some embodiments, the stretch yarns are filament yarns formed from the elastomeric fibers disclosed above. The stretch yarns are not particularly durable or resistant to heat and fire and thus tend to degrade or melt from exposure to such extreme conditions. Thus, it may be desirable, but certainly not required, to orient other yarns or fibers that do have some heat/flame resistance at least partially around the stretch yarns so as to protect them. The flame resistant yarns (which may include the ballistic and/or secondary yarns disclosed above) may be oriented at least partially around the stretch yarns, such as via plying or helically wrapping the stretch yarns. U.S. Pat. Nos. 5,527,597 and 5,694,981 (both of which are incorporated herein in their entirety) illustrate fabric configurations whereby stretch yarns are helically wrapped with flame resistant yarns to form a protected stretch yarn (see Figure 1). A single flame resistant yarn or multiple flame resistant yarns may be used to wrap a stretch yarn. In an alternative embodiment, flame resistant fibers may be spun around the stretch yarn so as to form a protective sheath about the stretch yarns. Again, however, it certainly is not required that the stretch yarns be so protected.

For woven fabrics, the stretch yarns may be provided in the warp and/or fill direction or in both directions.

For knitted fabrics, the stretch yarns may be incorporated in a variety of ways. In some embodiments, the stretch yarns may be knitted with the other yarns (such as those described above) using standard knitting techniques, including plating. In some embodiments, not all courses or wales include a stretch yarn. By way only of example, stretch yarns may be provided only in alternating courses or wales. In other embodiments, the stretch yarns are "laid in" during the knitting process. In one such non-limiting configuration, the stretch yarns are not technically knitted with the other yarns but rather are inserted during the knitting process and essentially trapped by the knit structure so as to be retained in the fabric.

Blends of the ballistic and secondary fibers disclosed herein may also be used to form a nonwoven fabric. In some embodiments, the ballistic fibers comprise 25-100% and the secondary fibers (comfort fibers, dyeable fibers, or some combination of both) comprise 0-75% of the fibers in the fabric. In some embodiments, the ballistic fibers comprise 25-80% and the secondary fibers (comfort fibers, dyeable fibers, or some combination of both) comprise 20-75% of the fibers in the fabric. In some embodiments, the ballistic fibers comprise 45-70% and the secondary fibers (comfort fibers, dyeable fibers, or some combination of both) comprise 30-55% of the fibers in the fabric. In some embodiments, the ballistic fibers comprise 40-60% and the secondary fibers comprise 40-60% of the fibers in the fabric. In some embodiments, front/back lapping may be used to form the nonwoven fabric such that the nonwoven fabric has a different blend on the face versus the back of the nonwoven fabric. In some embodiments, the nonwoven fabric is formed with multiple layers. The nonwoven fabric may be formed with any number of layers. Moreover, the fiber blend of the various layers can be, but may not be, the same. Moreover, layers having different fiber blends may be oriented within the nonwoven fabric in any order (e.g., ABAB, ABCABC, ABACABAC, etc., where A, B, and C are each a layer utilizing a unique fiber blend).

Ballistic fabrics contemplated herein may consist of a single ply of the woven, knitted, or nonwoven fabrics disclosed herein or alternatively may be formed with multiple plies of such fabrics, by means of quilting, laminating, adhering, etc.

In some embodiments, the fabrics contemplated herein have a weight greater than 2.5 ounces/yd$^2$ and less than 12.5 ounces/yd$^2$, inclusive. In some embodiments, the fabrics contemplated herein have a weight of between 2.5-11 ounces/yd$^2$, between 5-9 ounces/yd$^2$, and between 5-7 ounces/yd$^2$, inclusive. In some embodiments, the fabrics have a weight of 6 ounces/yd$^2$, 8.5 ounces/yd$^2$, or 11 ounces/yd$^2$.

Embodiments of the fabrics may be tested pursuant to the $V_{50}$ Ballistic Test set forth in MIL-STD-662F, Department of Defense Test Method Standard, $V_{50}$ Ballistic Test for Armor, Dec. 18, 1997.

In some embodiments, a single ply of fabric has a $V_{50}$ value of at least 700 fps for a 2 grain projectile. In some embodiments, the $V_{50}$ value for a single ply is at least 900 fps and in some embodiments the $V_{50}$ value for a single ply is over 1000 fps, inclusive. A double ply of some fabric embodiments can have even higher $V_{50}$ values, some over 1100 fps, inclusive.

In some embodiments, a single-ply knitted fabric layer (i) includes ballistic fibers and secondary fibers, (ii) has a weight between 2.5-12.5 osy, inclusive, and (iii) has a $V_{50}$ value greater than 700 fps. In some embodiments, this knitted fabric layer also includes stretch yarns.

In some embodiments, a single-ply knitted fabric layer (i) includes ballistic spun yarns having no more than 95% ballistic fibers, (ii) has a weight between 2.5-12.5 osy, inclusive, and (iii) has a $V_{50}$ value greater than 700 fps.

In some embodiments, a single-ply knitted fabric layer (i) includes at least two different ballistic fibers, (ii) has a weight between 2.5-12.5 osy, inclusive, and (iii) has a $V_{50}$ value greater than 700 fps. In some embodiments, this knitted fabric layer includes ballistic yarns comprising the at least two different ballistic fibers. In a still further embodiment, these ballistic yarns are spun yarns.

In some embodiments, a single-ply knitted fabric layer (i) includes at least two different ballistic fibers, (ii) has a weight between 2.5-11 osy, inclusive, and (iii) has a $V_{50}$ value greater than 700 fps.

In some embodiments, a single-ply knitted fabric layer (i) includes at least two different ballistic fibers, (ii) has a weight between 2.5-12.5 osy, inclusive, and (iii) has a $V_{50}$ value greater than 900 fps.

In some embodiments, a single-ply knitted fabric layer (i) includes ballistic spun yarns and secondary yarns, (ii) has a weight between 2.5-10 osy, inclusive, and (iii) has a $V_{50}$ value greater than 700 fps.

In some embodiments, a single-ply knitted fabric layer (i) includes ballistic yarns, secondary yarns, and stretch yarns (ii) has a weight between 2.5-12.5 osy, inclusive, and (iii) has a $V_{50}$ value greater than 700 fps. In some embodiments, the ballistic yarns of this knitted fabric layer are spun yarns.

In some embodiments, a single-ply knitted fabric layer (i) includes ballistic yarns and stretch yarns, (ii) has a weight between 2.5-12.5 osy, inclusive, and (iii) has a $V_{50}$ value greater than 700 fps. In some embodiments, the ballistic yarns of this knitted fabric layer are spun yarns.

In some embodiments, a single-ply knitted fabric layer (i) includes ballistic filament yarns and secondary yarns, (ii) has a weight between 2.5-11 osy, inclusive, and (iii) has a $V_{50}$ value greater than 700 fps.

In some embodiments, a single-ply knitted fabric layer (i) includes ballistic filament yarns and secondary yarns, (ii) has a weight between 2.5-12.5 osy, inclusive, and (iii) has a $V_{50}$ value greater than 900 fps.

In some embodiments, a single-ply knitted fabric layer (i) includes ballistic filament yarns and stretch yarns, (ii) has a weight between 2.5-11 osy, inclusive, and (iii) has a $V_{50}$ value greater than 700 fps.

In some embodiments, a single-ply knitted fabric layer (i) includes ballistic filament yarns and stretch yarns, (ii) has a weight between 2.5-12.5 osy, inclusive, and (iii) has a $V_{50}$ value greater than 900 fps.

In some embodiments, a single-ply knitted fabric layer (i) includes ballistic filament yarns and ballistic spun yarns, (ii) has a weight between 2.5-12.5 osy, inclusive, and (iii) has a $V_{50}$ value greater than 700 fps.

In some embodiments, a single-ply knitted fabric layer (i) includes ballistic filament yarns and ballistic spun yarns, (ii) has a weight between 2.5-11 osy, inclusive, and (iii) has a $V_{50}$ value greater than 700 fps.

In some embodiments, a single-ply knitted fabric layer (i) includes ballistic filament yarns and ballistic spun yarns, (ii) has a weight between 2.5-12.5 osy, inclusive, and (iii) has a $V_{50}$ value greater than 900 fps.

In some embodiments, a single-ply knitted fabric layer (i) includes ballistic filament yarns, ballistic spun yarns, and stretch yarns, (ii) has a weight between 2.5-11 osy, inclusive, and (iii) has a $V_{50}$ value greater than 700 fps.

In some embodiments, a single-ply knitted fabric layer (i) includes ballistic filament yarns, ballistic spun yarns, and stretch yarns, (ii) has a weight between 2.5-12.5 osy, inclusive, and (iii) has a $V_{50}$ value greater than 900 fps.

The following single ply ballistic fabrics having the disclosed blends and constructions were tested pursuant to the $V_{50}$ Ballistic Test.

TABLE 1

| Sample No. | Blend | Yarn Type | Style | Fabric Wt. (osy) | V50 (fps) |
|---|---|---|---|---|---|
| 1 | 65/25/10 [FR rayon/para-aramid/nylon] | Spun | Interlock | 11.2 | 742 |
| 2 | 100% para-aramid | Spun | Interlock | 6.1 | 777 |
| 3 | 100% para-aramid + Spandex knitted in | Spun | Stretch Interlock | 6.2 | 905 |
| 4 | 100% para-aramid + Spandex knitted in | Filament | Stretch Interlock | 6.6 | 955 |
| 5 | 100% para-aramid (face)\| 65/25/10 [FR rayon/ para-aramid/nylon] (back) | Filament\| Spun | Plated Jersey | 8.8 | 772 |
| 6 | 100% para-aramid (face)\| 40/50/10 [FR rayon/para-aramid/nylon] (back) | Spun\|Spun | Plated Jersey | 6.1 | 753 |
| 7 | 40/50/10 [FR Rayon/para-aramid/nylon] (exposed)\| 100% para-aramid (embedded) | Spun\|\|Spun | Plated Interlock | 8.6 | 811 |

These single-ply ballistic fabrics were tested as 15 inch square samples pursuant to the 2 grain RCC ("right circular cylinder") $V_{50}$ Ballistic Test, in a rigid frame and backed by air. The $V_{50}$ number notes the velocity (in feet per second) at which the probability of penetration of the fabric by the projectile is 50 percent. In this table, the symbol "|" denotes a fabric that has a different blend for its technical face and technical back. In this table, the symbol "| |" denotes a fabric that has two yarns of different blends oriented such that the first yarn is exposed on the technical face and technical back of the fabric and the second yarn is embedded in the fabric. The blend to the left of the symbol is the fabric with which the testing projectile first comes in contact when striking the fabric.

Dyeing and printing of the disclosed fabrics may be carried out in accordance with standard methods, all of which are known to those of skill in the art. Any of the fibers disclosed herein may be producer-colored in that color is imparted to the fibers during the fiber formation process.

Embodiments of the ballistic fabrics disclosed herein may be incorporated into a variety of different garments in various ways. Such garments may include, but are not limited to, shirts, pants, protective undergarments, gloves, knee and elbow pads, jumpsuits, t-shirts, etc. The entirety of the garments may be formed from the inventive fabrics, or alternatively such fabrics may be incorporated into the garments at strategic locations. In one embodiment, the entirely of the garment is formed of the fabric (e.g., protective undergarments). In other embodiments, pockets or enclosures are provided on the exterior or interior of the garment in strategic locations (e.g., the forearms, groin area, femoral arteries, etc.). The ballistic fabric is positioned within the pockets as protective inserts to stop penetration of the ejecta through the garment.

The ballistic fabrics may be provided as inserts that are removable and replaceable in the pockets. Placement of the pockets on a garment may be customized depending on the task of the wearer and not all pockets need be filled with protective inserts. Furthermore, different types of protective inserts may be available. In this way, the protection afforded the wearer by the garment may be customized and tailored to a particular situation.

In other embodiments, the garment is constructed so that the ballistic fabric forms desired portions of the garment. By way only of example, the arms of the garment may be formed from ballistic fabrics disclosed herein. Alternatively, panels or patches of fabrics disclosed herein may be adhered, sewn, or otherwise attached to an existing garment at desired locations. Still further, the ballistic fabric may be supplied in a layer or film that is attached (such as via adhering, stitching, laminating, etc.) to the fabric at the desired locations.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

We claim:

1. A ballistic fabric consisting of a single-ply flame resistant knit fabric, wherein the single-ply flame resistant knit fabric comprises opposing first and second fabric faces and is formed by interlooping yarns, wherein the single-ply flame resistant knit fabric is uncoated such that at least some of the interlooping yarns are exposed on at least one of the first and second fabric faces, wherein at least some of the interlooping yarns comprise ballistic fibers, wherein at least some of the ballistic fibers comprise flame resistant ballistic fibers, and wherein the single-ply flame resistant knit fabric has a $V_{50}$ of at least 700 feet per second with a 2 grain projectile when tested in compliance with MIL-STD-662F, Department of Defense Test Method Standard, $V_{50}$ Ballistic Test for Armor, Dec. 18, 1997.

2. The ballistic fabric of claim 1, wherein the single-ply flame resistant knit fabric comprises a circular single-knit fabric or a circular double-knit fabric.

3. The ballistic fabric of claim 2, wherein the single-ply flame resistant knit fabric comprises a circular double-knit fabric formed on one of a rib-gaited machine or an interlock-gaited machine.

4. The ballistic fabric of claim 1, wherein at least some of the interlooping yarns comprise filament yarns.

5. The ballistic fabric of claim 4, wherein at least some of the filament yarns comprise para-aramid filament yarns.

6. The ballistic fabric of claim 1, wherein each of the interlooping yarns comprises a fiber blend and wherein the fiber blends of all of the interlooping yarns are the same.

7. The ballistic fabric of claim 6, wherein the fiber blend of each of the interlooping yarns comprises aramid fibers.

8. The ballistic fabric of claim 7, wherein the fiber blend of each of the interlooping yarns comprises 100% para-aramid fibers.

9. The ballistic fabric of claim 8, wherein all of the interlooping yarns are filament yarns.

10. The ballistic fabric of claim 1, wherein each of the interlooping yarns comprises a fiber blend and wherein the fiber blend of at least some of the interlooping yarns are different.

11. The ballistic fabric of claim 1, wherein all of the interlooping yarns comprising ballistic fibers comprise 100% ballistic filament yarns.

12. The ballistic fabric of claim 1, wherein the single-ply flame resistant knit fabric has a weight of at least 10 osy.

13. The ballistic fabric of claim 1, wherein at least some of the flame resistant ballistic fibers comprise inherently flame resistant ballistic fibers.

14. The ballistic fabric of claim 13, wherein at least some of inherently flame resistant ballistic fibers comprise aramid fibers.

15. The ballistic fabric of claim 14, wherein the aramid fibers comprise para-aramid fibers.

16. The ballistic fabric of claim 1, wherein at least some of the interlooping yarns comprise only ballistic fibers.

17. The ballistic fabric of claim 1, wherein at least some of the interlooping yarns comprise secondary fibers.

18. The ballistic fabric of claim 17, wherein at least some of the interlooping yarns comprise only secondary fibers.

19. The ballistic fabric of claim 17, wherein a majority of the ballistic fibers in the single-ply flame resistant knit fabric are exposed on the first fabric face and a majority of the secondary fibers in the single-ply flame resistant knit fabric are exposed on the second fabric face.

20. The ballistic fabric of claim 17, wherein one of the ballistic fibers or the secondary fibers in the single-ply flame resistant knit fabric is predominantly exposed on the first fabric face and on the second fabric face and the other of the ballistic fibers or the secondary fibers in the single-ply knit fabric is substantially embedded within the single-ply flame resistant knit fabric between the first and second fabric faces.

21. The ballistic fabric of claim 1, wherein at least some of the interlooping yarns are stretch yarns.

22. A garment comprising the ballistic fabric of claim 1.

23. The ballistic fabric of claim 1, wherein at least some of the interlooping yarns comprise filament yarns and other of the interlooping yarns comprise spun yarns.

24. The ballistic fabric of claim 23, wherein at least some of the filament yarns and at least some of the spun yarns comprise ballistic fibers.

25. The ballistic fabric of claim 1, wherein the single-ply flame resistant knit fabric has a $V_{50}$ of at least 900 feet per second with a 2 grain projectile when tested in compliance with MIL-STD-662F, Department of Defense Test Method Standard, $V_{50}$ Ballistic Test for Armor, Dec. 18, 1997.

26. The ballistic fabric of claim 1, wherein at least some of the interlooping yarns comprise a first type of ballistic fiber and wherein at least some of the interlooping yarns comprise a second type of ballistic fiber.

27. The ballistic fabric of claim 26, wherein at least some of the interlooping yarns comprise both the first type and the second type of ballistic fibers.

28. The ballistic fabric of claim 1, wherein the single-ply flame resistant knit fabric complies with the thermal protective requirements set forth in NFPA 2112 (2007).

29. A ballistic fabric consisting of a single-ply flame resistant circular knit fabric, wherein the single-ply flame resistant circular knit fabric comprises opposing first and second fabric faces and is formed by interlooping yarns, wherein the single-ply flame resistant circular knit fabric is uncoated such that at least some of the interlooping yarns are exposed on at least one of the first and second fabric faces, wherein all of the interlooping yarns are 100% aramid filament yarns, and wherein the single-ply flame resistant circular knit fabric has a $V_{50}$ of at least 700 feet per second with a 2 grain projectile when tested in compliance with MIL-STD-662F, Department of Defense Test Method Standard, $V_{50}$ Ballistic Test for Armor, Dec. 18, 1997.

30. The ballistic fabric of claim 29, wherein all of the interlooping yarns are 100% para-aramid filament yarns.

31. The ballistic fabric of claim 29, wherein the single-ply flame resistant circular knit fabric has a $V_{50}$ of at least 900 feet per second with a 2 grain projectile when tested in compliance with MIL-STD-662F, Department of Defense Test Method Standard, $V_{50}$ Ballistic Test for Armor, Dec. 18, 1997.

32. The ballistic fabric of claim 29, wherein the single-ply flame resistant circular knit fabric has a weight of at least 10 ounces per square yard.

33. The ballistic fabric of claim 29, wherein the single-ply flame resistant circular knit fabric complies with the thermal protective requirements set forth in NFPA 2112 (2007).

34. A garment comprising the ballistic fabric of claim 29.

35. A ballistic fabric consisting of a single-ply flame resistant circular knit fabric, wherein the single-ply flame resistant circular knit fabric comprises opposing first and second fabric faces and is formed by interlooping yarns, wherein the single-ply flame resistant circular knit fabric is uncoated wherein the single-ply flame resistant knit fabric is uncoated such that at least some of the interlooping yarns are exposed on at least one of the first and second fabric faces, wherein all of the interlooping yarns are 100% para-aramid filament yarns, and wherein the single-ply flame resistant circular knit fabric has a weight of at least 10 ounces per square yard and a $V_{50}$ of at least 700 feet per second with a 2 grain projectile when tested in compliance with MIL-STD-662F, Department of Defense Test Method Standard, $V_{50}$ Ballistic Test for Armor, Dec. 18, 1997.

36. The ballistic fabric of claim 35, wherein the single-ply flame resistant circular knit fabric has a $V_{50}$ of at least 900 feet per second with a 2 grain projectile when tested in compliance with MIL-STD-662F, Department of Defense Test Method Standard, $V_{50}$ Ballistic Test for Armor, Dec. 18, 1997.

37. The ballistic fabric of claim 35, wherein the single-ply flame resistant circular knit fabric complies with the thermal protective requirements set forth in NFPA 2112 (2007).

* * * * *